US005553774A

United States Patent [19]

Goodno

[11] Patent Number: 5,553,774

[45] Date of Patent: Sep. 10, 1996

[54] PRESSURE SEAL C-FOLDED MAILER

[75] Inventor: Brian Goodno, Manchester, N.H.

[73] Assignee: Moore Business Forms, Inc., Grand Island, N.Y.

[21] Appl. No.: 394,478

[22] Filed: Feb. 27, 1995

[51] Int. Cl.[6] ..... B65D 27/06

[52] U.S. Cl. ..... 229/303; 229/69; 229/305; 229/306; 229/314

[58] Field of Search ..... 229/303, 304, 229/305, 92.1, 92.3, 314, 316, 69, 306

[56] References Cited

U.S. PATENT DOCUMENTS

| | | | |
|---|---|---|---|
| 1,091,172 | 3/1914 | Thayer . | |
| 2,317,335 | 4/1943 | Whitman . | |
| 2,396,221 | 3/1946 | Yancey . | |
| 2,402,821 | 6/1946 | Kostcling . | |
| 2,910,222 | 10/1959 | Bermingham, Jr. et al. . | |
| 3,126,148 | 8/1964 | Hanson . | |
| 3,143,279 | 8/1964 | Black . | |
| 3,152,800 | 10/1964 | Hanson . | |
| 3,184,150 | 5/1965 | Hubbard . | |
| 3,228,586 | 1/1966 | Hayes, Jr. . | |
| 3,255,952 | 6/1966 | Black . | |
| 3,557,519 | 1/1971 | Lyon, Jr. . | |
| 3,652,007 | 3/1972 | MacDougall | 229/304 |
| 3,946,938 | 3/1976 | Kranz . | |
| 4,044,942 | 8/1977 | Sherwood . | |
| 4,706,878 | 11/1987 | Lubotta et al. . | |
| 4,754,915 | 7/1988 | Steidinger . | |
| 4,830,269 | 5/1989 | Jenkins . | |
| 4,889,278 | 12/1989 | Steidinger . | |
| 4,896,823 | 1/1990 | Taylor . | |
| 4,915,287 | 4/1990 | Volk et al. . | |
| 4,928,875 | 5/1990 | Hutchinson . | |
| 4,951,864 | 8/1990 | Dicker . | |
| 5,167,739 | 12/1992 | Hutchinson et al. . | |
| 5,174,493 | 12/1992 | File . | |
| 5,201,464 | 4/1993 | File . | |
| 5,263,637 | 11/1993 | Simson . | |
| 5,288,014 | 2/1994 | Meyers et al. . | |
| 5,290,225 | 3/1994 | Younger . | |
| 5,294,041 | 3/1994 | Whiteside . | |
| 5,314,110 | 5/1994 | Lombardo . | |
| 5,346,123 | 9/1994 | Lombardo . | |
| 5,370,304 | 12/1994 | Sauerwine et al. . | |
| 5,375,764 | 12/1994 | Sauerwine . | |
| 5,425,500 | 6/1995 | Sauerwine | 229/92.3 X |

FOREIGN PATENT DOCUMENTS

| | | | |
|---|---|---|---|
| 212352 | 9/1991 | Japan | 229/92.1 |
| 404018253 | 1/1992 | Japan | 229/92.1 |

*Primary Examiner*—Jes F. Pascua
*Attorney, Agent, or Firm*—Nixon & Vanderhye

[57] ABSTRACT

A C-fold mailer comprises first, second and third panels foldable about a first foldline with the first and second panels in registration one with the other and a second foldline with the third panel overlying the back side of the first panel. Lines of cohesive are formed along the lateral margins and the first foldline of the first and second panels to adhere the panels one to the other, forming a return envelope. The first panel has a return flap with rewettable adhesive. A third panel has segments of cohesive adjacent its distal edge for registration and adherence to corresponding segments of adhesive.

17 Claims, 4 Drawing Sheets

PRESSURE SEAL C-FOLDED MAILER

TECHNICAL FIELD

The present invention relates to a continuous business form web which can be separated into discrete forms and folded to form mailers having an integral return envelope, and particularly relates to a C-fold mailer with return envelope which can be readily manufactured on a pressure seal press in one operation to minimize costs.

BACKGROUND

Continuous business form webs have previously been separated into discrete forms and folded to form mailers with integral return envelopes. Those form constructions, however, have been complex in nature, requiring a number of different steps to complete the mailer at substantial cost. Pressure seal machines are currently employed by both original forms manufacturers and customers of form manufacturers to form discrete mailers. They are capable of forming C, Z and V mailers. It is important, however, to provide a mailer wherein the customer need not attempt to provide inserts to the mailer such as return envelopes which complicate the form's construction and increase its cost.

DISCLOSURE OF THE INVENTION

In accordance with the present invention, there is provided a one-part, cut sheet, pressure seal C-fold form with integral return envelope. The form is initially disposed in roll form. Adhesive, perforations and printing are applied to the web at the appropriate locations. The web is then sheeted and subsequently folded and sealed, using a pressure seal press, either at the forms manufacturing site or at a customer's site. If the forms are folded and sealed at the customer's site, the manufacturer of the form will ship the forms flat whereby the customer can print additional information on the forms as necessary and desirable. In the seal press, the individual forms are folded and sealed without need for insertions such as return envelopes because the C-fold mailer includes as part of two of its panels, an integral formed return envelope.

The mailer includes an elongated sheet having first, second and third panels spaced longitudinally one from the other and connected one to the other by first and second longitudinally spaced, laterally extending foldlines delineating on their opposite sides the first and second panels and the second and third panels, respectively. Lines of adhesive are applied along the opposite margins of the first and second panels on opposite sides of the first foldline and extend from the first foldline to terminate short of the end edges of the first and second panels. Adhesive is also applied along the margins of the first and second panels on opposite sides of the first foldline. Thus, when the first and second panels are folded about the first foldline and pass through a pressure sealer, the lateral edges and the margins of the first and second panels about the foldline are sealed one to the other to form a return envelope having an opening opposite the first foldline. One or the other of the first and second panels includes a line of perforations short of its end defining a return envelope flap. Rewettable adhesive may be applied to the flap. The third panel is provided with spaced lines of cohesive adjacent its end margin for overlying, when the third panel is folded about the second foldline into overlying relation with the back side of the first panel, corresponding lines of adhesive on the first panel adjacent the first foldline on its rear face. Consequently, by folding the third panel about the second foldline and passing the mailer through the pressure seal press, the mailer is completely formed.

When a recipient receives the mailer, it will be appreciated that the lateral margins between the front face of the third panel and the rear face of the first panel are not adhered one to the other, enabling the user to insert a finger or an opener into that space whereby a perforation line corresponding to the second foldline can be severed. A third panel may additionally have a laterally extending perforation line between its opposite end edges defining, for example, a coupon or a stub containing certain information which the recipient will place in the return envelope after the stub is completed for forwarding to an addressee preprinted on the first or second panel of the mailer. Consequently, by tearing the third coupon along the intermediate lines of perforation defining the coupon, the coupon can be inserted into the envelope formed by the first and second panels with the return flap then being wetted and folded over and adhered to the second panel.

In an alternate version, the return envelope may have a back underneath seal rather than a back overseal. Stated differently, the return address printing on the return envelope may be inverse from the previously described form of the mailer.

In a still further form of the present invention, a die-cut window with a glassine patch may be provided in the first or second panels. Thus, the recipient's address may appear through the glassine panel in the initial mailing. Upon receipt by a recipient, the return coupon may also include a return address. Thus, the return coupon can be inserted into the return envelope, with the return address showing through the window for mailing to a further addressee.

In a preferred embodiment according to the present invention, there is provided a mailer with integral return envelope comprising an elongated sheet having first, second and third panels spaced longitudinally one from the other along the sheet and connected to one another along first and second longitudinally spaced, laterally extending foldlines between the first and second panels and the second and third panels, respectively, lines of adhesive applied along longitudinally extending lateral margins of the first and second panels and along laterally extending adjoining margins of the first and second panels on opposite sides of the first foldline, the adhesive applied on one face of the sheet, the first and second panels being folded about the first foldline into registry with one another with the longitudinally extending lines of adhesive adhered to one another along opposite laterally spaced margins thereof and the laterally extending lines of adhesive adjacent margins of the first and second panels adhered to one another to form a return envelope for the mailer with an opening therefor adjacent the second foldline, a first pattern of adhesive applied to the third panel along the one face of the sheet and adjacent an end margin of the sheet and the third panel, a second pattern of adhesive applied to the first panel on a face of the sheet opposite one face and adjacent the first foldline, the third panel being folded about the second foldline to register with and overlie the first panel along the opposite face of the sheet with the first and second patterns of adhesive registering with and adhering to one another to form a completed mailer.

In a further preferred embodiment according to the present invention, there is provided a mailer with integral return envelope comprising a sheet having first, second and third panels spaced one from the other along the sheet and connected to one another along first and second spaced foldlines extending generally parallel to one another between the first and second panels and the second and third panels, respectively, generally parallel lines of adhesive along margins of the first and second panels and extending generally normal to the first foldline, a line of adhesive along adjoining margins of the first and second panels on opposite sides of the first foldline, the adhesive applied on one face of the sheet, the first and second panels being folded about the first foldline into registry with one another with the generally parallel lines of adhesive adhered to one another along opposite margins of the first and second panels, the line of adhesive along adjoining margins of the first and second panels adhered to one another to form a return envelope for the mailer with an opening therefor adjacent the second foldline, a first pattern of adhesive applied to the third panel along one face of the sheet and adjacent an edge of the sheet and the third panel, a second pattern of adhesive applied to the first panel on a face of the sheet opposite one face and adjacent the first foldline, the third panel being folded about the second foldline to register with and overlie the first panel along the opposite face of the sheet with the first and second patterns of adhesive registering with and adhering to one another to form a completed mailer.

Accordingly, it is a primary object of the present invention to provide a novel and improved one-part cut-sheet pressure seal C-fold form with an integral return envelope.

BEST MODE FOR CARRYING OUT THE INVENTION

Figure 1:
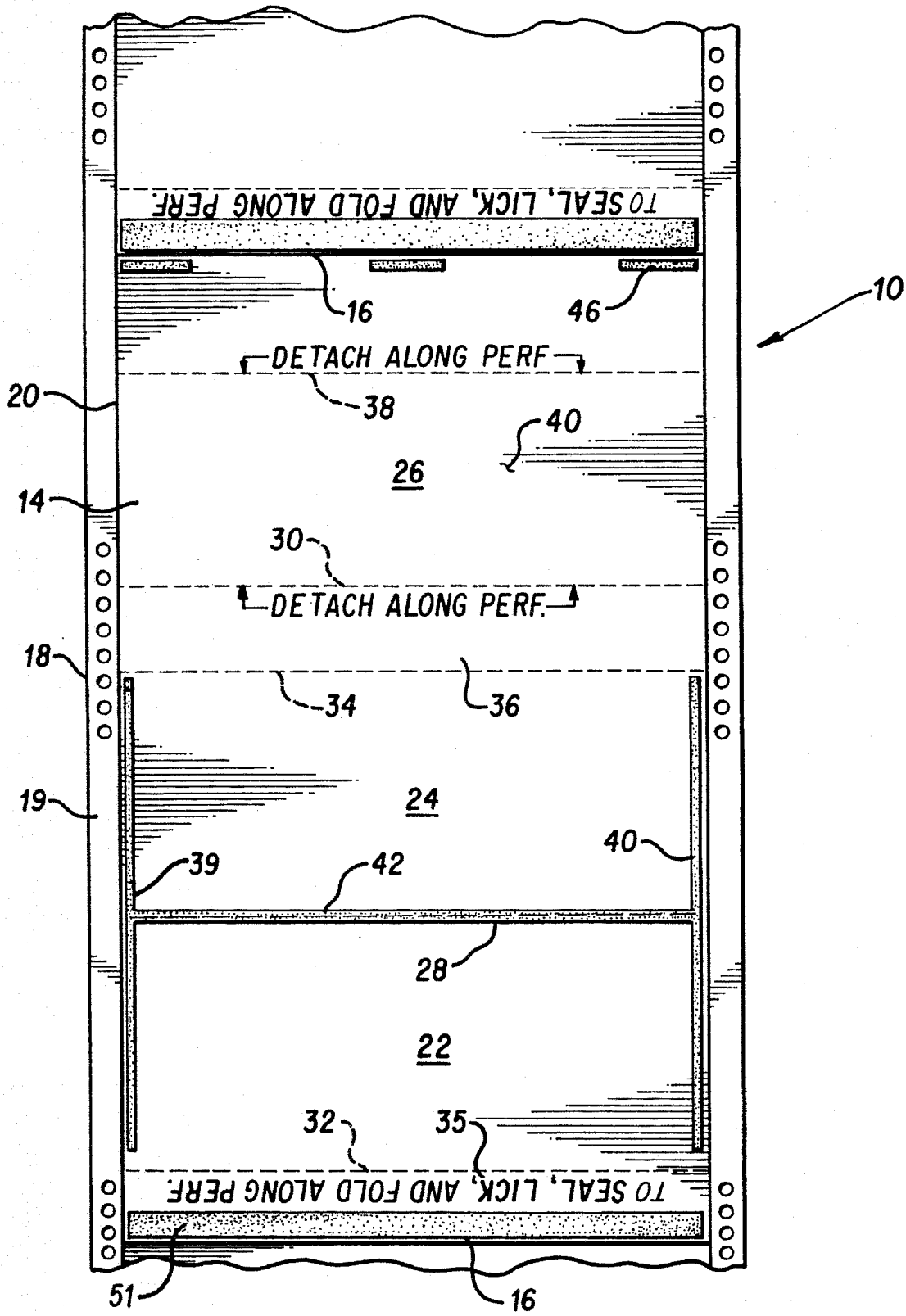
FIG. 1 is a fragmentary plan view of a continuous web for forming mailers constructed in accordance with the present invention.
Figure 3:
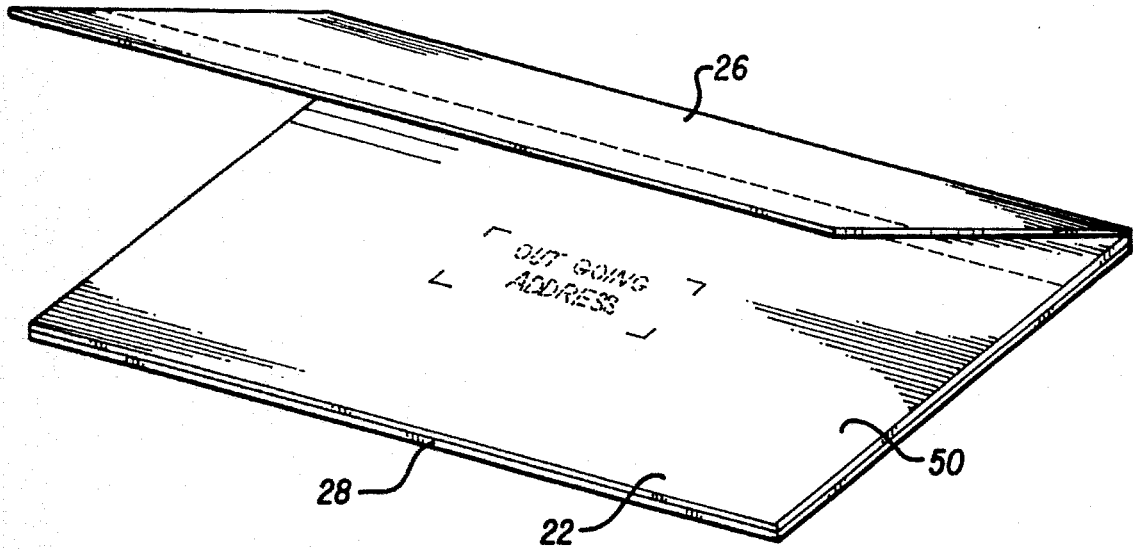
FIG. 3 is a perspective view illustrating the manner in which the sheet is folded to form a C-fold mailer according to the present invention.
Figure 5:
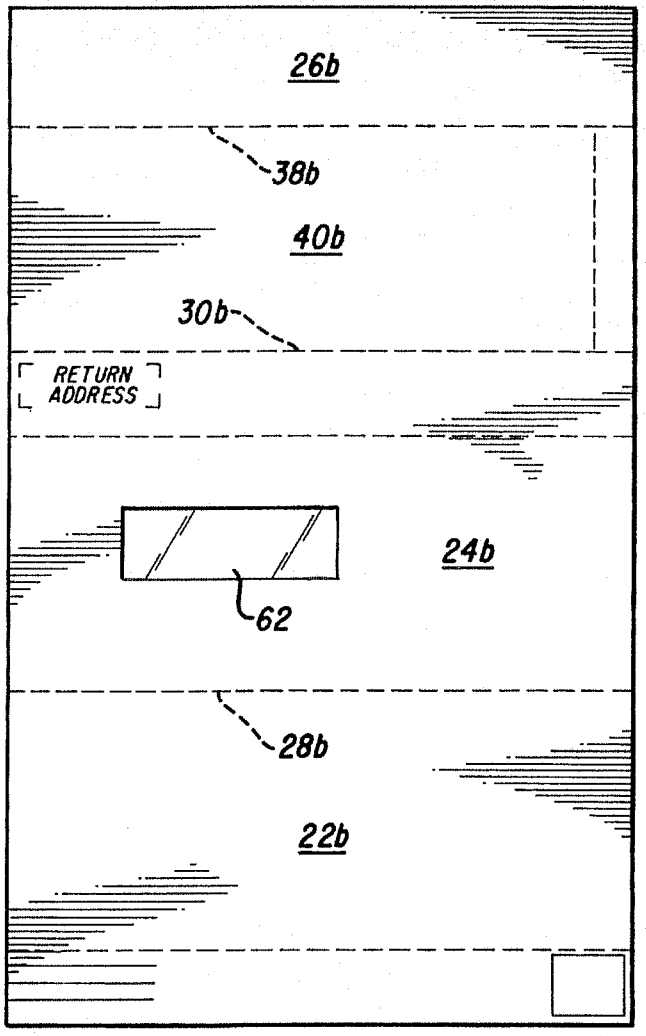
FIG. 5 is a plan view of the reverse side of FIG. 4.

Referring now to FIG. 1, there is illustrated a continuous business form web, generally designated 10, comprised preferably of a single ply of paper separable along transverse lines of perforation into elongated sheets for forming discrete mailers 12, as illustrated in FIG. 3. The sheets 14 illustrated in FIG. 1 are joined one to the other at opposite edges or ends by laterally extending lines of perforations 16. To process the continuous web, i.e., to apply adhesive, perforations, and printing, as described hereafter, tractor openings 18 are provided in continuous strips along opposite lateral edges of the continuous web and connected thereto by longitudinally extending lines of perforations 20. The tractor openings 18 facilitate handling of the continuous form by machines, such as high-speed printers, not shown, having correspondingly spaced tractor pins. In this manner, the single continuous ply of paper 10 may be disposed in various machines common in the printing industry for performing slitting, printing and adhesive applying operations on various portions of the form.

Upon separation of the individual sheets 14 from the continuous web, typically by employing a bursting machine, it will be seen that the discrete sheets 14 are divided into first, second and third panels 22, 24 and 26, respectively. The first and second panels 22 and 24 are joined one to the other along a transversely extending foldline 28 which may comprise a line of perforations. The second and third panels 24 and 26 are connected one to the other along a second foldline which preferably comprises a line of perforations 30. The term foldline is used herein to mean a weakened portion of the paper for purposes of folding the paper and does not necessarily include or exclude lines of perforations for purposes of separating one panel from the other, although preferably foldline 30 constitutes a line of perforations. As indicated previously, the marginal strips 19 containing the tractor feed openings 18 are detachable from the sheet 14 along longitudinally extending lines of perforations 20.

As a further review of FIG. 1 reveals, the first panel 22 is also provided with a transversely extending foldline 32 spaced back from the free end edge of the sheet 14 to form a flap 35 for the return envelope which forms an integral part of the mailer as described below. Preferably, the foldline 32 does not constitute a line of perforations. In second panel 24 and spaced back from the foldline 30 dividing panel 24 from panel 26, there is provided another transversely extending line of perforations 34. The distance between the line of perforations 34 and the foldline 30 separating panels 24 and 26 in a longitudinal direction corresponds to the distance between the end edge of panel 22 and line of perforations 32 whereby a panel or flap 36 formed between foldline 30 and line of perforations 34 corresponds in longitudinal extent to the longitudinal extent of the return envelope flap 35. In the third panel 26, a transversely extending line of perforations 38 is spaced back from the distal end edge of panel 26. The line of perforations 38 and 30 define a panel or return coupon 40 which, in use, may contain printing supplied by the sender of the mailer for detachment from the mailer, possibly for filling in by the recipient of the mailer, and insertion into the return envelope for return to the sender.

For forming the C-fold mailer, plural lines of cohesive are provided at various locations on the front and back side of the sheet 14, it being appreciated that the cohesive is preferably applied to the continuous web prior to detachment of the sheets from the web. The cohesive is of the type known at TN-124, described and illustrated in U.S. Pat. No. 4,918,128, the disclosure of which is incorporated herein by reference. To form the C-fold mailer using the cohesive, longitudinally extending lines 39 and 40 of cohesive are provided along the opposite lateral edges of panels 22 and 24 directly adjacent the longitudinally extending lines of perforations 20. The lines of cohesive 39 and 40, however, terminate at their opposite ends short of the transversely extending lines of perforation 32 and 34. Additionally, a laterally extending line of cohesive 42 is provided along and on opposite sides of foldline 28, a transverse line of cohesive 42 extending between the longitudinally extending lines 39 and 40 of cohesive. Thus, it will be appreciated that when the panel 22 is folded about foldline 28 into registration with panel 24, the portions of the longitudinally extending lines of cohesive 39 and 40 in each panel will lie in registration with one another, respectively. Further, the portions of the transversely extending line of cohesive 42 on opposite sides of the transverse foldline 28 will register with one another. Consequently, when the form is disposed through a pressure seal press, these registering lines of adhesive will secure panels 22 and 24 to one another, forming a return envelope.

Figure 2B:
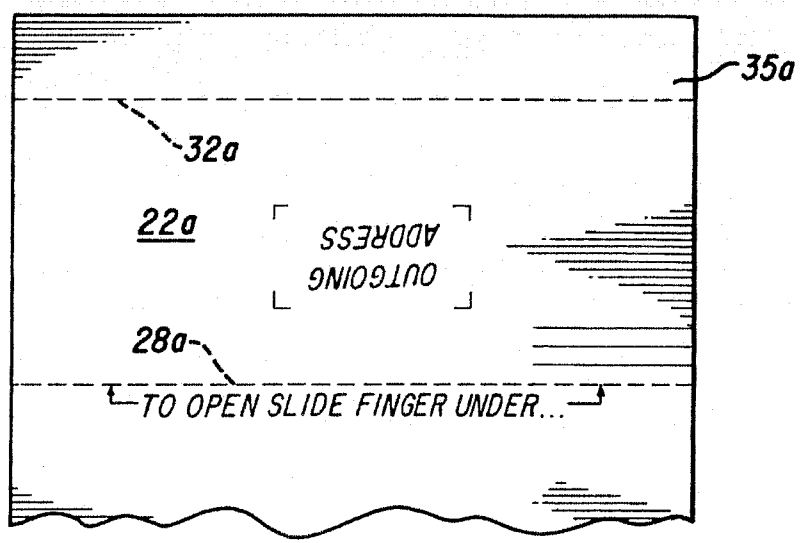
FIG. 2B is a fragmentary view of a portion of the sheet forming the mailer according to another embodiment of the present invention.
Figure 2A:
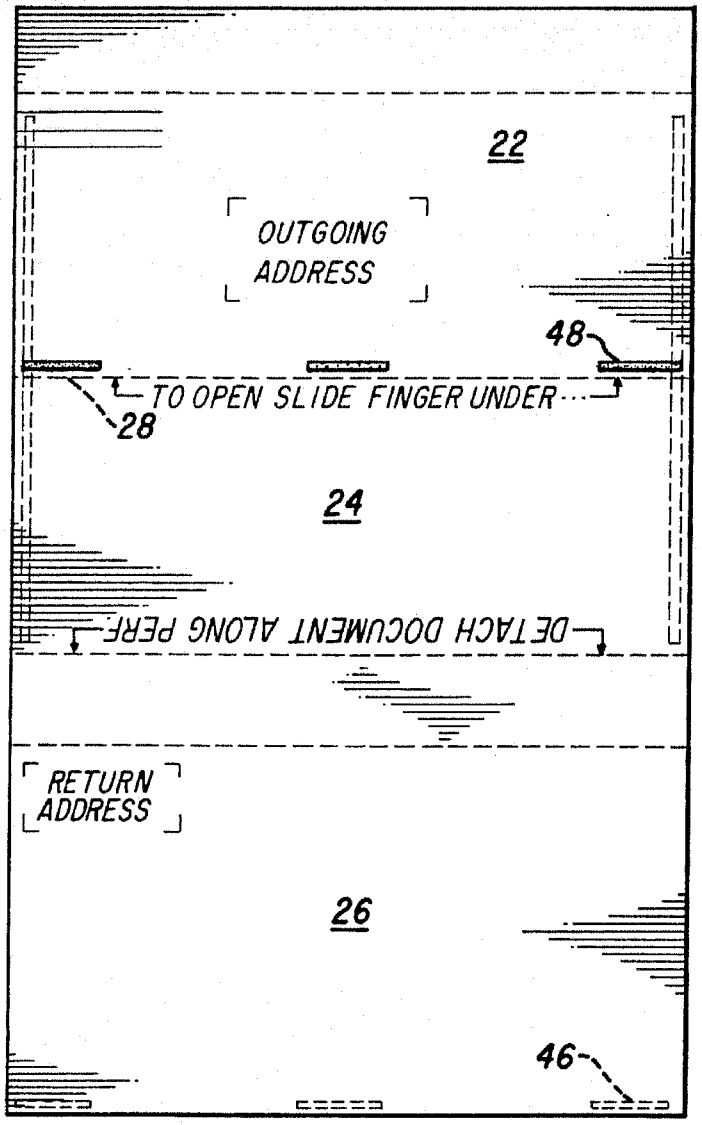
FIG. 2A is a plan view of the reverse side of a sheet detached from the web illustrated in FIG. 1 for forming a mailer.

A plurality of laterally spaced lines of cohesive 46 are provided on the front face of panel 26 adjacent its distal edge as illustrated in FIG. 1. In a preferred form, three segments of cohesive 46 are provided, two of which lie adjacent the lateral margins of the sheet, while the third lies centrally of the sheet. As illustrated in FIG. 2A, the back side of sheet 14 and particularly the back side of panel 22 adjacent the foldline 28 has transversely extending lines or segments of cohesive 48. The transversely extending segments of cohesive 46 of panel 26 register with the transversely extending segments of cohesive 48 when the panel 22 is folded about foldline 28 into registration with panel 24 and panel 26 is folded about foldline 30 into registration with the back side of panel 22.

Referring now to FIG. 3, in order to form the C-fold mailer, the sheets 14 are first separated from the web. This can be accomplished either before or after the printing, adhesive and lines of peltorations are applied to the sheets 14. The sheets are passed through a pressure seal press which folds the first panel 22 about the foldline 28 into registration with the front face of the second panel 24. As indicated previously, the longitudinally extending lines of cohesive 39 and 40, as well as the portions of the cohesive 42 on opposite sides of foldline 28 lie in registration upon folding the first and second panels. By applying pressure to the opposite edges of the folded first and second panels, the panels are adhered to one another along their lateral edges and the foldline 28 forms a return envelope 50 with the return envelope flap 35 lying in registration with the detachable panel 36. The flap 35 includes a transversely extending line of rewettable adhesive 51 for rewetting by the recipient of the mailer when the return envelope is to be forwarded. The third panel 26 is folded about the foldline 30 into registration with the back side of the first panel 22. Particularly, the transversely extending lines of cohesive of third panel 26 register with the transversely extending lines 48 of cohesive on the back side of the first panel 22. By applying pressure, the distal edge of the third panel 26 is secured to the back side of first panel 22 adjacent the foldline 28, thus completely sealing the mailer.

It will be appreciated, however, that the lateral edges of the mailer between panels 26 and 22 are not adhered one to the other, enabling insertion of an individual's finger or a letter opener between the panels. Thus, the recipient may, upon receipt of the mailer, detach the third panel 26 from the second panel 24 along the line of perforations 30. By detaching the third panel 26 and removing the end panel, the return coupon 40 is formed and may be inserted into the return envelope 50, together with other materials, such as a check. By additionally removing the panel 36 from the second panel 24, the return envelope flap 35 may be folded about foldline 32 such that the rewettable adhesive registers with the back side of second panel 24 adjacent the line of perforation 34 whereby the return envelope can be sealed.

Referring now to FIG. 2A, there is illustrated an alternate version of the mailer wherein the return envelope has a back underneath seal, as compared to a back overseal, as previously described. Essentially, the structure of the mailer remains the same as previously described and the out-going and return addresses on the first panel **22*a* are reversed, thus placing the return envelope flap 35*a* at the bottom of the return envelope as viewed from the mailing address side of the envelope. Thus, the return flap 35*a* would be folded about foldline 32*a* for securement to the back side of panel 24** as in the prior embodiment.

Figure 4:
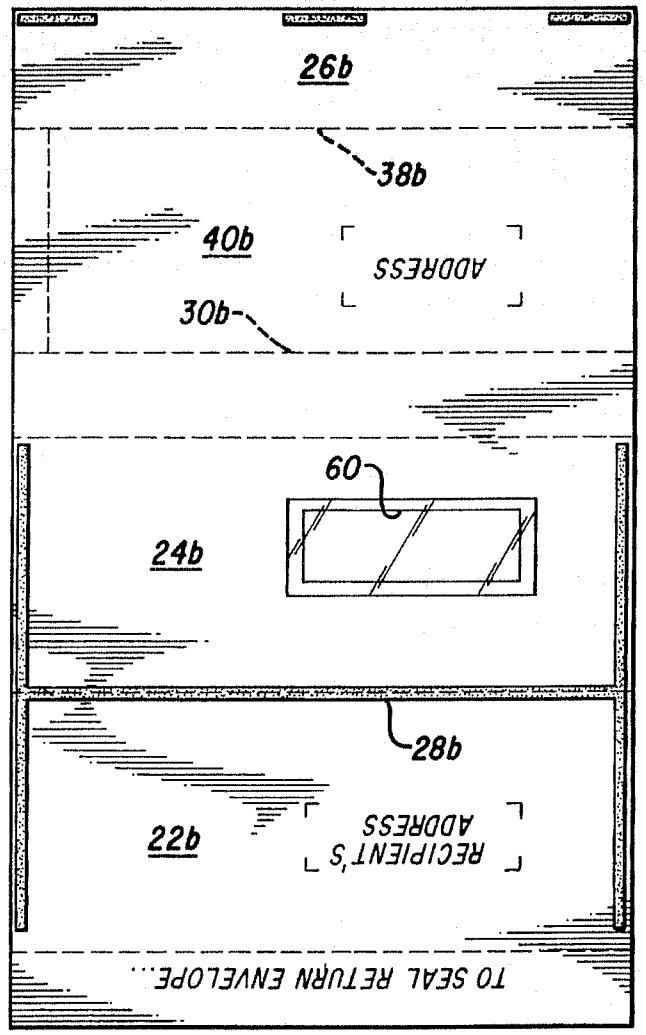
FIG. 4 is a view similar to FIG. 1 illustrating a single sheet constructed in accordance with a further form of the present invention.

Referring to FIG. 4, wherein like reference numerals apply to like parts, followed by the suffix "b," the construction of this mailer is similar as in the embodiment illustrated in FIG. 1. In this form, however, a die-cut window 60 is formed in the second panel **24*b* and a glassine patch 62 is secured about the window 60. In this configuration, the die-cut window and glassine patch exhibit the recipient's address through the window the first time the form is mailed. The return coupon 40*b* may have the next address preprinted on the coupon. Thus, the recipient of the original mailer may insert the coupon 40*b* into the return envelope 50*b*, with the preprinted address appearing through the die-cut window 60** for mailing to the address appearing through the window.

It will be appreciated that while the sheet has been described and illustrated as having a longitudinal extent greater than a lateral extent, with that longitudinal extent extending in the direction of the web, the sheets in the web can be located transversely with the long dimension of each sheet extending in a transverse direction of the web. Thus, rather than an "H" configuration of cohesive formed by the cohesive lines 39, 40 and 42 as viewed in the direction of web travel, the lines of cohesive 39, 40 and 42 may form an I configuration when the form is oriented such that its long dimension extends in the lateral direction of the web. Hence, the marginal strips would be applied along the shorter dimensions of the sheet.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A mailer with integral return envelope comprising:

an elongated sheet having first, second and third panels spaced longitudinally one from the other along said sheet and connected to one another along first and second longitudinally spaced, laterally extending foldlines between said first and second panels and said second and third panels, respectively;

lines of pressure seal adhesive applied along longitudinally extending lateral margins of said first and second panels and along laterally extending adjoining margins of said first and second panels on opposite sides of said first foldline, said adhesive applied on one face of said sheet;

said first and second panels being folded about said first foldline into registry with one another with said longitudinally extending lines of adhesive adhered to one another along opposite laterally spaced margins thereof and said laterally extending lines of adhesive adjacent margins of the first and second panels adhered to one another to form a return envelope for said mailer with an opening therefor adjacent said second foldline;

a first pattern of pressure seal adhesive applied to said third panel along said one face of said sheet and adjacent an end margin of said sheet and said third panel;

a second pattern of pressure seal adhesive applied to said first panel on a face of said sheet opposite said one face and adjacent said first foldline;

said third panel being folded about said second foldline to register with and overlie said first panel along the opposite face of said sheet with said first and second patterns of adhesive registering with and adhering to one another to form a completed mailer.

2. A mailer according to claim 1 wherein said longitudinally extending lines of adhesive extend from said first foldline along the lateral margins of said first and second panels and terminate short of end edges of said first and second panels, one of said first and second panels having a laterally extending foldline between the end terminations of said longitudinally extending lines of adhesive and a laterally extending edge of said one panel remote from the first foldline forming a return envelope flap, and adhesive applied along said flap.

3. A mailer according to claim 2 including a laterally extending line of perforations along another of said one of said first and second panels between the end terminations of said lines of adhesive and the laterally extending edge of said other panel remote from the first foldline to define a second flap.

4. A mailer according to claim 3 wherein said lines of adhesive along laterally extending adjoining margins of the first and second panels on opposite sides of said first foldline are substantially continuous between said longitudinally extending lines of adhesive.

5. A mailer according to claim 1 wherein the lateral margins of said first and third panels overlie one another in the mailer and are unsecured to one another substantially throughout their longitudinal extent.

6. A mailer according to claim 1 wherein the third panel includes a line of perforations extending laterally between opposite longitudinal edges of said panel inset from said second foldline and the end edge of said third panel.

7. A mailer according to claim 1 including a die-cut window in one of said first and second panels for displaying address information placed on another of said first and second panels.

8. A mailer according to claim 1 wherein said lines of adhesive along laterally extending adjoining margins of the first and second panels on opposite sides of said first foldline are substantially continuous between said longitudinally extending lines of adhesive.

9. A mailer with integral return envelope comprising:

a sheet having first, second and third panels spaced one from the other along said sheet and connected to one another along first and second spaced foldlines extending generally parallel to one another between said first and second panels and said second and third panels, respectively;

generally parallel lines of pressure seal adhesive along margins of said first and second panels and extending generally normal to said first foldline, lines of pressure seal adhesive along adjoining margins of said first and second panels on opposite sides of said first foldline, said adhesive applied on one face of said sheet;

said first and second panels being folded about said first foldline into registry with one another with said generally parallel lines of adhesive adhered to one another along opposite margins of said first and second panels, said line of adhesive along adjoining margins of the first and second panels adhered to one another to form a return envelope for said mailer with an opening therefor adjacent said second foldline;

a first pattern of pressure seal adhesive applied to said third panel along said one face of said sheet and adjacent an edge of said sheet and said third panel;

a second pattern of pressure seal adhesive applied to said first panel on a face of said sheet opposite said one face and adjacent said first foldline;

said third panel being folded about said second foldline to register with and overlie said first panel along the opposite face of said sheet with said first and second patterns of adhesive registering with and adhering to one another to form a completed mailer.

10. A mailer according to claim 9 wherein said parallel lines of adhesive extend from said first foldline along opposite margins of said first and second panels and terminate short of edges of said first and second panels parallel to said foldlines, one of said first and second panels having a foldline between the end terminations of said parallel lines of adhesive and an edge of said one panel remote from the first foldline forming a return envelope flap, and adhesive applied along said flap.

11. A mailer according to claim 10 including a line of perforations along another of said one of said first and second panels between the end terminations of said lines of adhesive and an edge of said other panel remote from the first foldline to define a second flap.

12. A mailer according to claim 11 wherein said lines of adhesive along laterally extending adjoining margins of the first and second panels on opposite sides of said first foldline are substantially continuous between said longitudinally extending lines of adhesive.

13. A mailer according to claim 9 wherein margins of said first and third panels normal to said foldlines overlie one another in the mailer and are unsecured to one another substantially throughout their extent.

14. A mailer according to claim 9 wherein the third panel includes a line of perforations extending between opposite margins of said third panel spaced from said second foldline and an edge of said third panel.

15. A mailer according to claim 9 including a die-cut window in one of said first and second panels for displaying address information placed on another of said first and second panels.

16. A mailer according to claim 9 wherein said lines of adhesive along laterally extending adjoining margins of the first and second panels on opposite sides of said first foldline are substantially continuous between said longitudinally extending lines of adhesive.

17. A continuous single-ply web of paper separable along transverse lines of perforations into plural elongated sheets for forming discrete mailers, each said sheet including first, second and third panels spaced longitudinally one from the other along said sheet and connected to one another along first and second longitudinally spaced, laterally extending foldlines between said first and second panels and said second and third panels, respectively;

lines of pressure seal adhesive applied along longitudinally extending lateral margins of said first and second panels and along laterally extending adjoining margins of said first and second panels on opposite sides of said first foldline, said adhesive applied on one face of said sheet;

said first and second panels being foldable about said first foldline into registry with one another with said longitudinally extending lines of adhesive located within said sheet for registration with one another along opposite laterally spaced margins thereof and said laterally extending lines of adhesive adjacent margins of the first and second panels located within said sheet for registration with one another for forming a return envelope for said mailer with an opening therefor adjacent said second foldline;

a first pattern of pressure seal adhesive applied to said third panel along said one face of said sheet and adjacent an end margin of said sheet and said third panel;

a second pattern of pressure seal adhesive applied to said first panel on a face of said sheet opposite said one face and adjacent said first foldline;

said third panel being foldable about said second foldline to register with and overlie said first panel along the opposite face of said sheet with said first and second patterns of adhesive located within said sheet for registration with one another to form a completed mailer.

* * * * *